US005127108A

United States Patent [19]

Weiss

[11] Patent Number: 5,127,108

[45] Date of Patent: Jul. 7, 1992

[54] TROUSERS INCLUDING ELASTIC INNER PANELS FOR FLATTENING PLEATS

[76] Inventor: Phyllis Weiss, 11555 S.W. 93rd Ct., Miami, Fla. 33176

[21] Appl. No.: 690,010

[22] Filed: Apr. 23, 1991

[51] Int. Cl.[5] ..... A41D 1/06

[52] U.S. Cl. ..... 2/237; 2/236; 2/220; 2/221

[58] Field of Search ..... 2/237, 236, 220, 221

[56] References Cited

U.S. PATENT DOCUMENTS

| | | | |
|---|---|---|---|
| 1,672,017 | 6/1928 | Wright | 2/237 |
| 3,169,531 | 2/1965 | Grishman | 128/519 |
| 3,333,589 | 8/1967 | Cohen et al. | 128/519 |
| 3,457,926 | 7/1969 | Bacon et al. | 2/237 |
| 3,478,367 | 11/1969 | Vatti | 2/221 |
| 4,516,275 | 5/1985 | Schroeder | 2/308 |
| 4,834,459 | 5/1989 | Leach | 297/467 |

*Primary Examiner*—Werner H. Schroeder

*Assistant Examiner*—Gloria Hale

*Attorney, Agent, or Firm*—Eckert Seamans Cherin & Mellott

[57] ABSTRACT

Trousers are provided with front panels and rear panels attached along inseams and outer seams, along a rear seam, and along a front, with a waistband formed around a top. A gathered area is disposed below the top portion of the waistband, and is circumferentially fuller than the top portion of the waistband. An inner elastic panel is attached at opposite ends behind the gathered area and arranged to draw the gathered area inwardly, providing a slimmer appearance. The waistband can be attached to the front and rear panels along a seam at which the panels are gathered via folded pleats. The elastic panel is attached along the seam to the waistband and to the front and rear panels on lateral sides of the pleats, preferably at a zipper or similar front opening, and at a pocket which is attached on an opposite side to the outer seam.

19 Claims, 4 Drawing Sheets

TROUSERS INCLUDING ELASTIC INNER PANELS FOR FLATTENING PLEATS

BACKGROUND OF THE INVENTION

1. Field of the Invention

This invention relates to the field of trouser construction, in particular to a slacks construction for women, wherein a fabric layer below the waistband is fuller than the waistband, for example having vertical pleats or gathers, and elastic panels are provided in the inner structure to pull the fuller areas circumferentially relative to the wearer, thereby flattening the pleats and/or circumferentially compressing the fuller area and providing a slimmer appearance.

2. Prior Art

Elastic panels have been included in clothing construction for the purpose of providing a girdle-like restraining support for the user's body, e.g., the abdomen. U.S. Pat. No. 3,457,926—Bacon et al, for example, discloses an abdomen compressing trouser structure having an inner belt mounted via elastic bands extending laterally from the front fastener around the sides of the trousers, captive between inner and outer layers of the waistband, to restrain protrusion of the abdomen using a structure located behind the outer layers of fabric. A restraining structure of this type is useful for supporting purposes and presumably will make a person appear slimmer, but is not comfortable due to its constriction of the wearer's abdomen.

Another example of a garment incorporating girdle-like elastic structures is disclosed in U.S. Pat. No. 3,333,589—Cohen et al, as applied to swim trunks. An inner panty is defined by an abdomen restraining strap of elastic, integral with an elastic seat. The swim trunks hang loosely over the panty, suspended from the waistband. A similar inner panty restraint is disclosed in U.S. Pat. No. 3,169,531—Grishman.

In garments which are intended to be comfortable rather than restraining, the fabric of the garment is intended to fit more loosely on the wearer. Trousers, for example, often include pleats defined by vertically elongated folds extending from a point, or between points, at which the pleats are folded and fixed. Remote from the point of attachment of the folds, the pleats can unfold to allow the fabric to expand freely in a direction perpendicular to the elongation or fold of the pleats, normally, horizontally. In a trouser construction, vertically aligned pleats are formed by folds in the fabric extending downwardly from a waistband, allowing the lower fabric to expand circumferentially remote from the waistband. Generally, the pleats taper from the folded part of the pleats, sewn to the waistband, to blend continuously into the fabric of the lower abdomen and leg area. This allows the trousers to expand over the wearer's lower abdomen, hips and the like, to comfortably accommodate a range of fit.

Pleated arrangements are comfortable and allow for circumferential expansion of the fabric. However, for the sake of a neat appearance the pleated garment structure is preferably dimensioned such that the pleats are not pulled into their expanded state when fitted properly. When the vertical pleats expand, the folds of the pleats tend to become more apparent, and extend farther outwardly from the surface of the garment than when folded flat.

An expansible structure similar to pleats is formed when the fabric along the abdomen is gathered rather than pleated, for example where elastic is included to compress the waistband and thereby wrinkle the fabric of the waistband as well as the abdomen area extending downwardly from the waistband. When pleats or gathers are expanded, the garment appears to be overly tight, and/or the wearer appears to have put on weight. Therefore, even though pleats and/or gathers are desirable for comfort, it is undesirable to rely on them for proper fit.

According to the invention a trouser construction includes a supplemental elastic panel disposed inside the trousers behind the pleats or gathers. The elastic is too light in weight to appreciably restrain the wearer's abdomen. However, the elastic tends to maintain the pleats or gathers in a preferentially compressed condition. A slimmer appearance is provided by the elastic because the capacity for circumferential expansion of the trousers, apart from the pleats or gathers, is used up before the pleats or gathers can expand. The garment is smoothed around the rear and the pleats or the like tend to remain flat. The wearer thus appears slimmer than in a trouser construction having pleats or gathers which can expand without limitation.

BRIEF DESCRIPTION OF THE DRAWINGS

There are shown in the drawings the embodiments of the invention as presently preferred. It should be understood, however, that the invention is not limited to the precise arrangements and instrumentalities shown, and is subject to embodiment in other groupings of its elements, in accordance with the definition of the invention claimed. In the drawings.

DETAILED DESCRIPTION OF THE PREFERRED EMBODIMENTS

Figure 1:
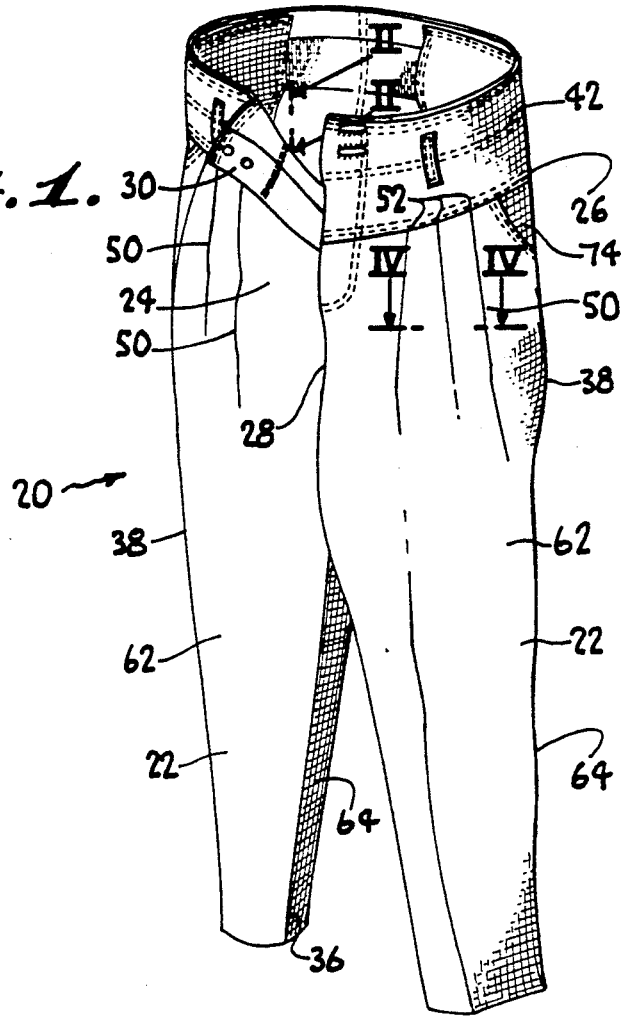
FIG. 1 is a perspective view of a trouser construction according to the invention.

Trouser construction 20, shown generally in FIG. 1, includes a waistband 42 connected to legs 22 so as to define a tube between the front or abdomen section 24 and the rear or seat section 26. The tube can be closed (e.g., with an elastic waistband), or provided with a detachable closure such as fly 30. Fly 30 has a zipper, buttons or the like on opposed flaps and leads to a front seam 28 extending along a midplane of the trousers, below the fly and around the crotch area to the seat. Another seam 34 (not shown in FIG. 1) extends up the seat along the midplane to the waistband.

Such trousers are basically defined by four quadrant panels which attach to the waistband, namely two front leg panels 62 and two rear leg panels 64. The front panels 62 each integrally include the front of one leg 22 and a lateral side of the abdomen. Each rear panel 64 includes the rear of a leg 22 and a lateral side of the seat. Between the waist and the legs the four panels are attached by vertical medial seams at the front and rear (the front one typically including the fly), and by vertical lateral seams or outer seams. More particularly, front and rear panels 62, 64 are joined along the inseams 36, the outer seams 38, the seat seam 34, the front seam 28, and the fly 30.

The leg panels 62, 64 are for the most part one thickness of fabric, with appropriate doubling at hems and seams. The waistband preferably is heavier and normally includes at least two thicknesses, such that the same material as the outside of the waistband is exposed along the inside of the waistband, at least at the top of the trousers. For this purpose, the waistband typically includes two substantially coextensive bands extending circumferentially around the wearer, or a layer of fabric which wraps over the top edge to the trousers, in either case providing an inside waistband layer 44, and an outside waistband layer 46 (see FIG. 3).

A pocket is provided with an exterior opening through the leg panel 62 or along the outer seam 38, in the area immediately below the waistband. The opening can extend along the outer seam 38 and along an upper edge of the respective leg panel 62 or 64 to define a triangular opening, or can be a slot opening along the outer seam or along the bottom edge of the waistband. A receptacle 76 for the body of the pocket depends inside the trousers and is attached along the edges of the opening at seams. In the embodiment of FIG. 1, the pocket opening is triangular and has a diagonal edge at the leg panel. Receptacle 76 is formed from two attached sections of material, including a section 74 that matches the external fabric (e.g., denim, cotton, etc.) and a section 76 that defines the body of the pocket and is concealed. The section 76 can be, for example muslin or the like.

The top of at least one of the leg panels, for example the two front leg panels 62, are gathered or folded in the area of the waistband to define at least one vertically oriented gather or pleat 50. In the embodiment of FIG. 1, wherein the leg panels 62, 64 and the waistband are formed from separate pieces of material, the leg panels 62 are lapped along the top edge to form a plurality of pleats 50 which are sewn into fixed folds at a seam attaching the leg panels 62 to the waistband. The tops 52 of the pleats 50 are deeply folded, for example the pleats being about one inch in width. The pleats taper to their bottoms 54, where they blend smoothly into the fabric of the leg panels. As a result of the pleats in the leg panels 62, the trousers in this embodiment are expandable horizontally to enlarge the circumference of the tube defined by the top portion of the trousers below the waistband, in the area of the abdomen.

Figure 2:
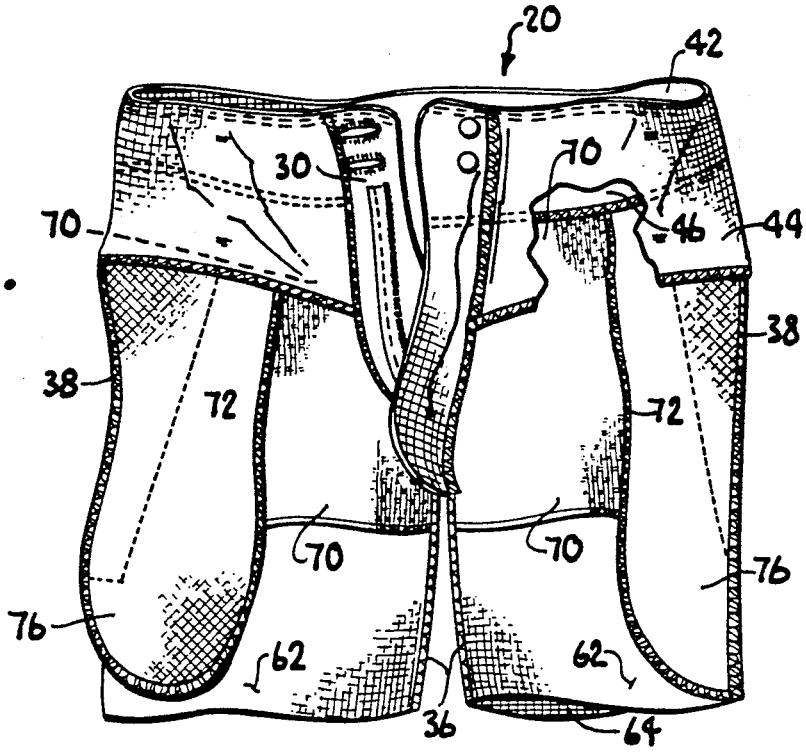
FIG. 2 is a partial elevation view thereof, with the trousers turned inside out, as at line 2—2 in FIG. 1, and showing the internal fabric and elastic panels.

However, according to the invention the expansion of the pleats is counteracted by an internal elastic panel 70, preferably two elastic panels on opposite sides of the trousers. The elastic panel 70 behind the pleats on each lateral side, as shown in FIG. 2 with the trousers turned inside out, is fixed relative to the fly 30 and relative to the outer seam 38, tending to resiliently shorten the front panel 62 along a horizontal (circumferential) line at the pleats. The elastic panel can be, for example, a length of lightweight nylon spandex. The elastic panel is preferably attached to the leg panels 62 along three seams and has a free bottom edge. In particular, the elastic panel is attached at seams along the fly 30, along the waistband 42 at the tops 52 of the pleats 50, and along a third seam 72, which is either attached directly to the outer seam 38, or as shown in FIG. 2 is attached to the pocket receptacle 76 at a seam remote from the outer seam.

Whereas the pocket receptacle 76 is made of a relatively non-extensible material as compared to the elastic panel 70 and as compared to the pleated leg portion 62, the elastic panel exerts an inward pressure between the outer seam 38 and the fly 30 as well as seam 28, extending below the fly. The elastic panel thus urges the pleats 50 into a more-folded condition wherein the pleats 50 appear as flat as possible given the dimensions of the wearer. The trousers remain comfortable because the elastic panel is relatively lightweight. However, the trousers have a relatively slimmer appearance due to the tendency of the pleats to remain flat. In the event the trousers fit snugly on the wearer, the elastic panel ensures that insofar as possible the snugness is arranged to elongate the fabric of the trousers apart from the pleats 50. The pleats 50 expand only when the elastic band has pulled the remainder of the trousers inwardly, thereby providing a smooth and close fit along the hips and across the rear of the trousers.

Figure 3:
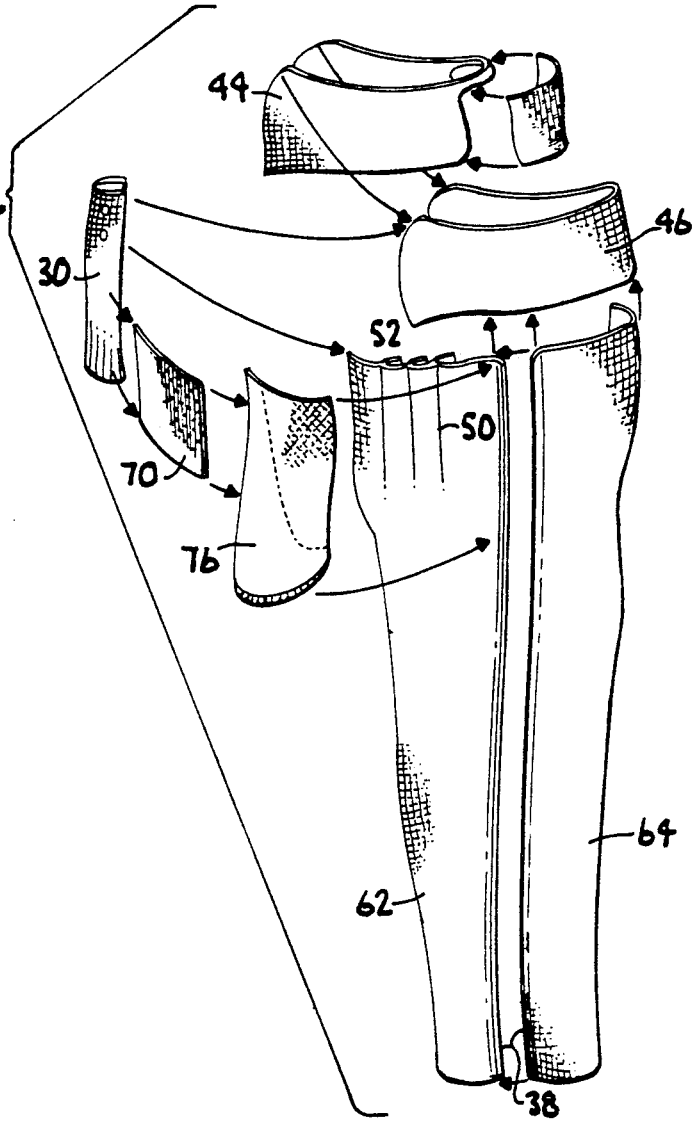
FIG. 3 is an exploded perspective view showing the respective fabric panels on one lateral side of the trousers, namely on the wearer's left, the trousers again shown inside out.

The respective pieces of fabric that make up a lateral half of the trousers of the invention are shown in FIG. 3 in an exploded view and turned inside out. The other lateral half is a mirror image of that shown. The pocket receptacle forms a tube which is closed at the bottom by a seam, and open at the top, the top being attached to the external pocket opening in or adjacent the leg panel. The tube is closed longitudinally along a seam 72 with the elastic panel 70. Therefore, the elastic panel also tends to flatten the pocket receptacle by pulling inwardly between the outer seam 38 and the fly 30, particularly when the fly is closed.

Figure 4A:
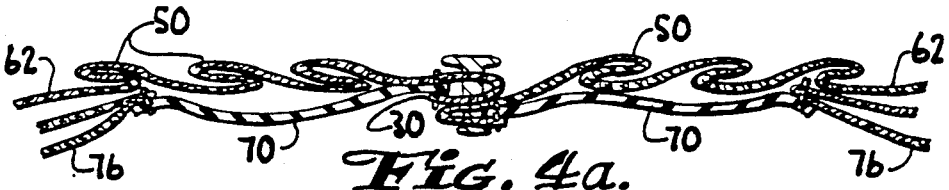
FIG. 4*a* is a section view along line 4—4 in FIG. 1, showing the trouser construction with the elastic panel at rest.
Figure 4B:
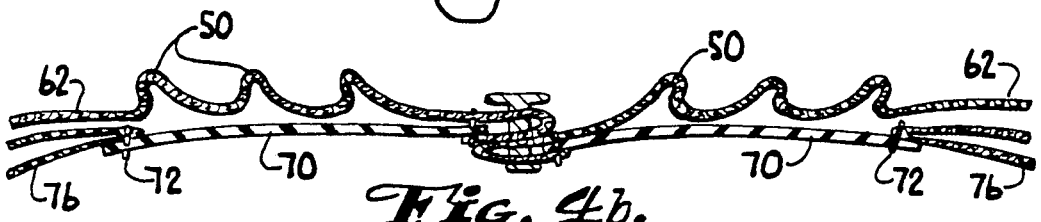
FIG. 4*b* is a section view along line 4—4 in FIG. 1, with the elastic panel stretched.
Figure 9:
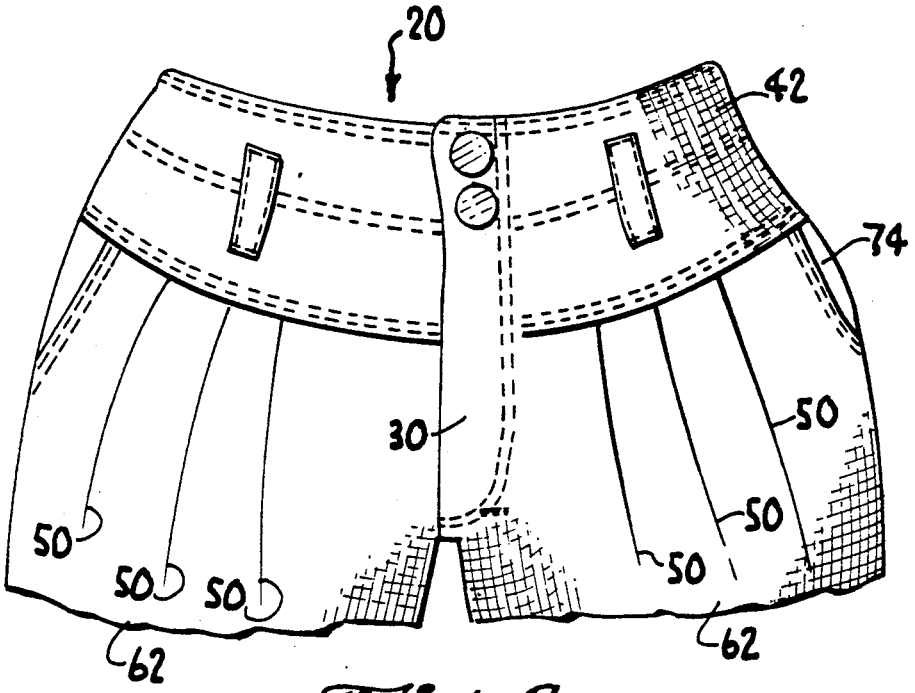
FIG. 9 is a partial elevation view of the front of the trousers of the invention, with the elastic at rest as in FIG. 4*a;* and, FIG. 10 is a partial elevation view corresponding to FIG. 9, with the elastic band stretched as in FIG. 4*b*.
Figure 10:
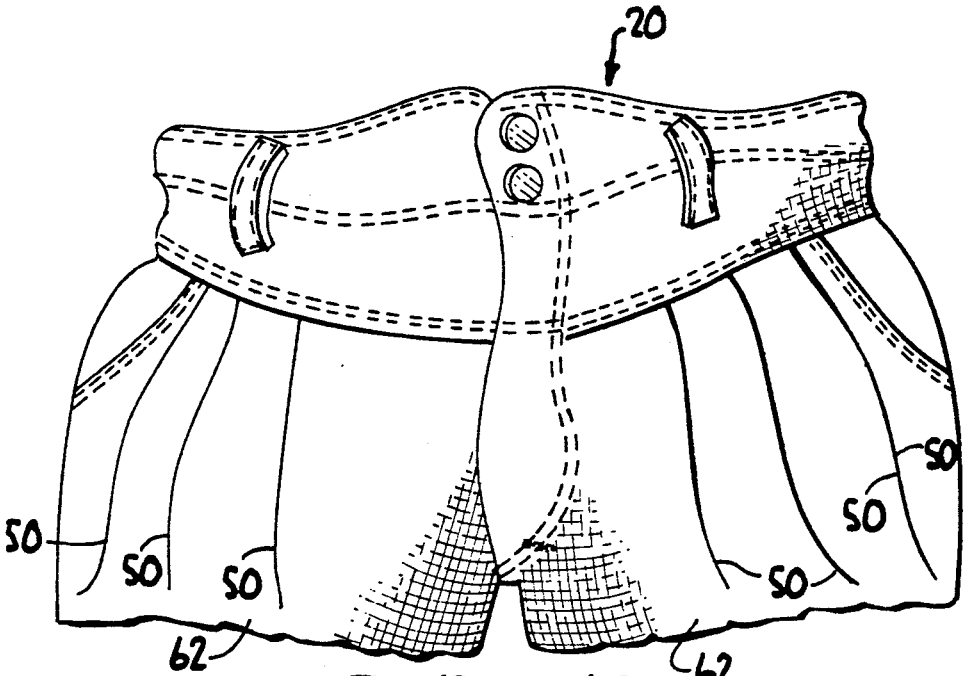

FIGS. 4*a* and 4*b* are cross sectional views through folded pleats according to the invention, taken along line 4—4 in FIG. 1, and demonstrating the difference in protrusion of the pleats 50 when drawn inwardly by the elastic band (FIG. 4*a*) or expanded due to a tight fit of the trousers on the wearer (FIG. 4*b*), which flares the pleats 50 and causes them to protrude. FIGS. 9 and 10 are front elevation views that also illustrate the difference in appearance between flat pleats (FIG. 9) and expanded, flaring ones (FIG. 10), the latter due to undue circumferential tension on the pleats.

In the embodiment according to FIG. 1, the pleats are not extensible at their extreme tops, due to their connection to the relatively less-extensible waistband at this point. In this embodiment the pleats flare from the point of their fixed attachment when expanded, and accordingly the elastic panel is preferably also attached to the waistband along an upper seam along the elastic panel. The elastic panel thus flares in the same manner as the pleated fabric of the leg panel 62. The elastic exerts an inward tension behind the pleats to counteract outward tension on the fabric, and tends to keep the pleats flat and folded.

Figure 5:
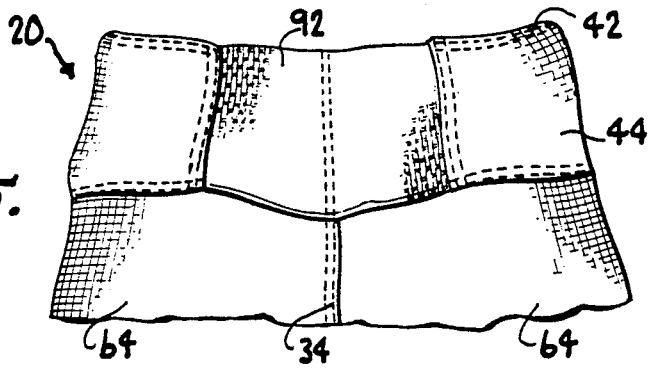
FIG. 5 is an inside out partial elevation view showing the upper inside waistband according to a first embodiment of the invention.

The elastic panel 70 urging the fly and outer seam toward one another can be supplemented by an optional rear elastic panel 92, as shown in FIG. 5. The rear elastic panel can also be made of nylon spandex, and occupies a portion of the inner facing of the waistband which is preferably centered over the seat seam 34. This panel is attached via seams to the inner facing of the waistband at the top and lateral ends of panel 92. The outer facing of the waistband in this embodiment is preferably a continuous length of relatively non-expansible material. By resiliently shortening the inner facing of the waistband, the panel 92 tends to keep the waistband from flaring outwardly from the wearer's waist and hips, further presenting a flat and neat appearance.

Figure 6:
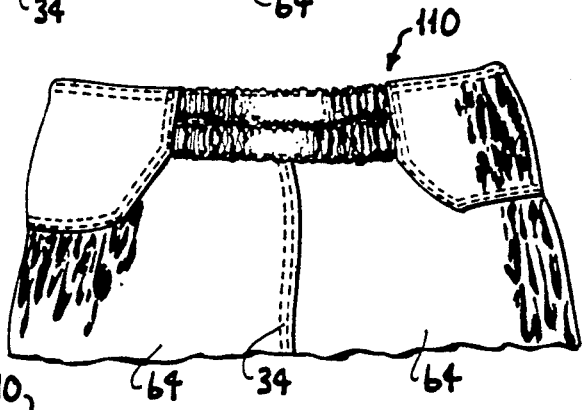
FIG. 6 is an inside out partial elevation view of the upper inside waistband according to an alternative embodiment.
Figure 7:
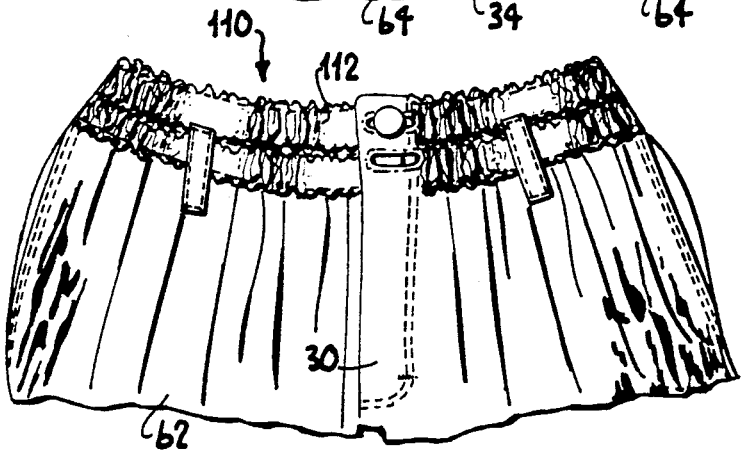
FIG. 7 is a partial front elevation view of an alternative embodiment of the invention.
Figure 8:
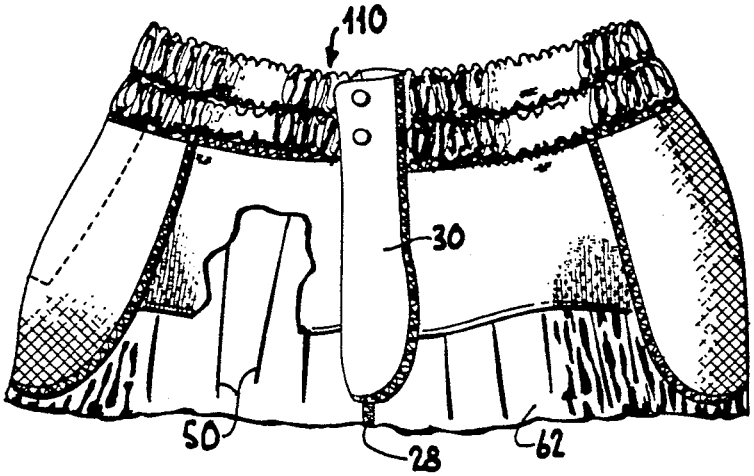
FIG. 8 is an inside out partial elevation view of the embodiment according to FIG. 7, from a direction corresponding to line 2—2 in FIG. 1.

The embodiment of FIGS. 1–3 and 5 is particularly applicable to thicker fabrics such as denim, washed cotton and the like, wherein the relative stiffness of the fabric helps to maintain a neat and flat appearance. An alternative trouser embodiment 110 according to the invention is shown in FIGS. 6–8, using a thinner material. Similar reference numbers are used in FIGS. 6–8 to identify similar structures to those of FIGS. 1–3. According to this embodiment, a waistband 112 is formed from a continuous extension of the leg panels 62, 64, the extension being folded over the top of the trousers to form the waistband. The waistband is sewn with circumferential elastic threads or embedded elastic strips which are tensioned during sewing, and when released compress the waistband to a smaller circumference than the circumference of the attached leg panels. This can be accomplished by actually sewing circumferential stitch lines, or by sewing an elastic band around the waistband, or both. Compression of the waistband forms a plurality of gathered or puckered areas in the waistband, and these areas expand against the resilience of the elastic thread to engage snugly on the wearer. Sufficient capacity is preferably provided in the arrangement that even when expanded, the portions of the leg panels below the waistband form a series of gathers or pleats 50 which are vertically elongated from the waistband. The gathers or pleats can be relatively more sinusoidal (i.e., rounded rather than folded), or can have an angular fold.

In the same manner as above, elastic panels 70 are provided on the inner surface of the trousers, connected at seams with the edges of the detachable closure at the fly, and with either the outer seam 38, or provided the pocket 32 is connected on one side to the outer seam, then to the inner edge of the pocket. The arrangement is shown with the trousers inside out in FIG. 8, and from the outside in FIG. 7. The elastic band causes the area of the pleats (i.e., the area between the fly and the outer seam) to remain compressed, preferentially pulling the material more tightly along the wearer's rear, rather than freely allowing expansion of the pleats or gathers. Although the rounded pleats are not flattened (due to the manner of their formation), the pleats are still relatively more compressed due to the elastic, providing a slimmer appearance to the trousers while maintaining the maximum in wearer comfort.

FIG. 6 illustrates an alternative form of waistband wherein an elastic strip is embedded in the waistband and produces an additional shortening influence in the area or the center rear of the waistband. The waistband at least in this area forms a tubular enclosure for one or more lengths of elastic, either attached at ends near either end of the tube, or sewn into the tube using elastic thread. A similar arrangement can be used for the waistband in general.

The invention is applicable to a wide range of fabrics and a wide range of specific constructions for the waistband and the trousers. As noted above, one variation is to connect the elastic band between the fly and the outer seam rather than between the fly and the pocket, with the pocket connected to the outer seam. In view of the convenient location of the pocket, and the additional benefit of flattening the pocket, according to the preferred embodiment the elastic extends between the fly and the pocket, with the pocket connected to the outer seam. The elastic is preferably attached to the trousers along three edges, namely the fly, the waistband, and the inner edge of the pocket, and the outer edge of the pocket is sewn into the outer seam.

Two forms of pleats have been illustrated according to the invention. The pleats in each case extend from a fixed point or relatively more folded point adjacent the waistband, and taper to where the pleats blend smoothly into the fabric opposite from the fixed or more folded point. The invention is also applicable to pleats which are fixed or fixedly folded at both opposite ends, although such constructions are normally used in areas which are intended to visibly expand more than trouser pleats, which are expected to lie flat when correctly fitted. Additional variations will be apparent to those skilled in the art.

According to the invention as disclosed above and as defined in the claims, the invention is a trouser construction 20 comprising a waistband 42 for encircling a wearer adjacent the wearer's hips, and seat and leg portions 26, 22 attached to the waistband 42, the waistband 42 and leg portions 22 terminating at a substantially vertical front opening 30 including a closure whereby ends of the waistband are detachably connectable, the seat and leg portions 26, 22 being at least slightly fuller in circumference than the waistband 42. At least one elastic band 70 is disposed on an inner surface of said waistband 42, seat 26 and leg 22 portions, the elastic band 70 being attached to at least one of the waistband, seat and leg portions and having ends attached on each side at said front opening 30 such that upon closing the front opening 30 the elastic band 70 resiliently draws said at least one of the seat and leg portions inwardly, thereby flattening the external appearance of the trouser construction. At least one pocket 32 is disposed adjacent the seat 26 and leg portions 22, formed by a receptacle 76 of material extending inwardly from an external opening, and wherein the elastic band 70 is attached at a lower terminus of the front opening 30 and extends to a seam 72 of said pocket 32. The pocket 32 preferably is attached to the seat and leg portions along a first seam 38 and to the front opening 30 along an opposite seam. At least one additional elastic band 92, 112, 114 can be attached to the waistband remote from the front opening.

The front opening 30 preferably includes a zipper having two coextensive detachable strips elongated vertically, and the elastic band 70 is attached adjacent each of the strips along a vertical seam. The elastic band 70 is also attached along a horizontal seam to the waistband 42 between the waistband and said seat and leg portions. At least one of the seat 26 and leg portions 22, 62, 64 is attached to the waistband 42 along a seam including a gathered section 50 in said at least one of the seat and leg portions, the waistband 42 being circumferentially shorter than said gathered section 50, and the elastic band 70 is attached relative to two seams 28-30 and 38 with the seat and leg portions, disposed laterally adjacent the gathered section 50, whereby the elastic portion 70 draws the gathered section circumferentially inwardly.

The gathered section is preferably defined by at least one substantially vertical pleat 50 in said at least one of the seat and leg portions 26, 62, 64, and the pleat 50 can be defined by two vertical folds in the gathered section and the gathered section, attached to the waistband 42 along a seam. Preferably the pleat 50 tapers from the waistband downwardly.

According to one embodiment the seat and leg portions are formed by left and right front and rear panels 62, 64, attached along a vertical seam 34 at a rear, along said front opening 30 at a front, and along vertical inseams 36, 34 and outer seams 38 along legs 22, gathered sections or pleats being disposed between the front opening and the outer seams.

The elastic band 70 preferably includes two lengths, one for each lateral side of the trousers, the two lengths each being attached at lateral ends relative to the front opening 30 and relative to one of the opposite outer seams 38. At least one pocket 32 has an external opening and an internal receptacle 76, the internal receptacle 76 of the pocket being attached along the front and rear panels 62, 64 at the outer seam 38, and to the elastic panel 70 along a vertical seam remote from the outer seam. The gathered section is preferably defined by a plurality of substantially vertical pleats 50 tapering from the waistband 42 downwardly. The pleats 50 can have overlapped folds at the waistband 42, the elastic band 70 being disposed substantially behind the pleats 50 between the front opening 30 and the outer seam 38, and drawing the front panel circumferentially inwardly, tending to urge the pleats into a flat, fully folded condition. The front and rear panels 62, 64 can be substantially formed of denim, washed cotton, or more flexible synthetic material or the like, and the elastic band can be lightweight nylon spandex.

The invention having been disclosed, a number of alternatives and variations within the scope and spirit of the invention will now become apparent to persons skilled in the art. Reference should be made to the appended claims rather than the foregoing discussion or exemplary embodiments to assess the scope of the invention in which exclusive rights are claimed.

I claim:

1. A trouser construction comprising:

a waistband defining an elongated strip and having two ends, for encircling a wearer when the ends of the waistband are brought together around the wearer, and seat and leg portions attached to the waistband, at least one of the seat and leg portions being at least slightly longer than the waistband along a longitudinal extension of said elongated strip, whereby the at least one seat and leg portion is fuller than the waistband;

a closure operable to connect the two ends of the waistband for closing the waistband around the wearer, and to detach the two ends of the waistband for allowing the trouser construction to be removed from the wearer;

at least one elastic band adjacent to an inner surface of said waistband, seat and leg portions, the at least one elastic band defining an inner layer therewith, the at least one elastic band exerting elastic tension between two ends of the elastic band in a direction parallel to said elongated strip of the waistband, said two ends of the elastic band being attached to at least one of the waistband, seat and leg portions such that upon connecting the two ends of the waistband via said closure the elastic band resiliently shortens said at least one of the seat and leg portions in said direction parallel to said elongated strip of the waistband, thereby causing the trouser construction to appear slimmer.

2. The trouser construction according to claim 1, wherein the waistband and at least one of the seat and leg portions define a fly opening extending vertically downward from the waistband, the closure including means operable to draw together the waistband and said at least one of the seat and leg portions at the fly opening, and further comprising at least one pocket adjacent to the seat and leg portions, the pocket being formed by a receptacle of material extending inwardly toward the wearer from an external opening in the trouser construction, and wherein the ends of the elastic band are respectively attached at a lower terminus of the fly opening and to a seam of said pocket.

3. The trouser construction according to claim 2, wherein the pocket is attached to the seat and leg portions along a first seam and to the fly opening along an opposite seam.

4. The trouser construction according to claim 3, further comprising at least one additional elastic band attached to the waistband remote from the fly opening.

5. The trouser construction according to claim 2, wherein the closure includes a zipper having two coextensive detachable strips elongated vertically, and wherein the elastic band is attached adjacent each of the strips along a vertical seam.

6. The trouser construction according to claim 5, wherein the elastic band is also attached along a horizontal seam to the waistband between the waistband and said seat and leg portions.

7. The trouser construction according to claim 1, wherein at last one of the seat and leg portions is attached to the waistband along a seam including a gathered section in said at least one of the seat and leg portions, the at least one seat and leg portion being fuller than the waistband due to said gathered section, and wherein the elastic band is attached at two seams disposed laterally adjacent the gathered section, whereby the elastic band draws the gathered section together in said direction parallel to the elongated strip of the waistband.

8. The trouser construction according to claim 7, wherein the gathered section is defined by at least one substantially vertical pleat in said at least one of the seat and leg portions, the pleat being defined by two vertical folds in the gathered section and the gathered section being attached to the waistband along a seam.

9. The trouser construction according to claim 8, wherein the pleat tapers from the waistband downwardly.

10. The trouser construction according to claim 7, wherein the seat and leg portions are formed by four panels, attached along lateral and medial vertical seams, one of said vertical seams including said closure, and wherein the gathered section is disposed between the vertical seam including said closure and a next adjacent one of the vertical seams.

11. The trouser construction according to claim 10, comprising at least two said gathered sections and wherein the elastic band includes two lengths, each being attached at respective said ends of the corresponding said elastic band relative to the vertical seam including the closure and relative to a respective said next adjacent one of the vertical seams.

12. The trouser construction according to claim 11, further comprising at least one pocket having an opening external of the trouser construction relative to the wearer and a receptacle structure disposed in the trouser construction with the wearer, the receptacle structure of the pocket being attached to one of the lateral seams, and to one of the ends of the elastic panel along a vertical seam remote from said one of the lateral seams.

13. The trouser construction according to claim 12, wherein the gathered section is defined by a plurality of substantially vertical pleats tapering from the waistband downwardly, the pleats being formed by overlaps defining folds at the waistband, the elastic band being disposed substantially behind the pleats between the closure and one of the lateral seams, and drawing the pleats together in the direction parallel to the elongated strip of the waistband, thereby tending to urge the pleats into a flat, fully folded condition.

14. The trouser construction according to claim 10, wherein the panels are substantially formed of denim and the elastic band comprises spandex.

15. A trouser construction comprising:

two front panels and two rear panels attached along lateral and medial seams to form trouser legs, a trouser seat, and a trouser front;

a waistband formed around a top of the front and rear panels, the waistband having a top portion defining a length in a circumferential direction encircling a wearer of the trouser construction;

a gathered area disposed below the top portion of the waistband, the gathered area being such that at least one of the front panels and rear panels and the waistband is is extendible in the circumferential direction to a length greater than the length of said top portion of the waistband; and, an elastic panel attached at opposite ends thereof behind the gathered area for shortening the gathered area in said circumferential direction.

16. The trouser construction according to claim 15, wherein the waistband is attached to the front and rear panels along a seam at which at least one of the front and rear panels is gathered to form at least one folded pleat, the elastic panel being attached along said seam to the waistband, the elastic panel having ends attached to said at least one of the front and rear panels on lateral sides of the at least one folded pleat, the elastic panel exerting tension between said ends whereby the elastic panel tends to flatten the pleat.

17. The trouser construction according to claim 16, further comprising a pocket depending inwardly of the trouser construction toward the wearer, the pocket being attached to one of said lateral seams located laterally outwardly of the at least one folded pleat relative to the wearer, and to the elastic panel on an opposite side of the at least one folded pleat, whereby the elastic panel tends to flatten the pocket as well as the pleat.

18. The trouser construction according to claim 17, wherein one of the lateral and medial seams of the trouser construction includes a detachable closure and wherein at least one said elastic panel is attached to said one of the lateral and medial seams on each side of the detachable closure.

19. The trouser construction according to claim 18, wherein a plurality of folded pleats are provided between the detachable closure and the corresponding one of said lateral and medial seams.

* * * * *